US005884700A

United States Patent [19]

Cook et al.

[11] Patent Number: 5,884,700

[45] Date of Patent: Mar. 23, 1999

[54] INTERIOR COATING OF GAS WELL TUBING

[75] Inventors: Thomas H. Cook, Gladewater; Donald A. Branton, Carthage; Ray D. Hudgins, Odessa, all of Tex.

[73] Assignee: Texaco Inc, White Plains, N.Y.

[21] Appl. No.: 933,184

[22] Filed: Sep. 18, 1997

[51] Int. Cl.[6] ..... B05C 1/00; B05D 7/22; E21B 23/10

[52] U.S. Cl. ..... 166/153; 166/170; 166/175; 166/244.1; 166/155; 427/239; 118/254; 118/DIG. 10

[58] Field of Search ..... 166/84.5, 153, 166/155, 170, 174, 175, 277, 312, 356; 118/254, DIG. 10; 427/239

[56] References Cited

U.S. PATENT DOCUMENTS

| | | | |
|---|---|---|---|
| 221,939 | 11/1879 | Root . | |
| 1,746,071 | 2/1930 | Cotton . | |
| 1,787,126 | 12/1930 | Steinnes . | |
| 1,796,337 | 3/1931 | Moore . | |
| 1,796,338 | 3/1931 | Moore . | |
| 1,799,385 | 4/1931 | Moore . | |
| 3,079,888 | 3/1963 | McLean | 113/7 |
| 3,105,554 | 10/1963 | McCall | 166/169 |
| 4,216,249 | 8/1980 | Clayton | 427/230 |
| 4,295,979 | 10/1981 | Sharp et al. | 166/244.1 |
| 5,117,909 | 6/1992 | Wilton et al. | 166/277 |
| 5,123,487 | 6/1992 | Harris et al. | 166/277 |

*Primary Examiner*—Roger Schoeppel
*Attorney, Agent, or Firm*—Henry H. Gibson; Arnold White & Durkee

[57] ABSTRACT

A method and apparatus for treating the production tubing string of a flowing gas well is disclosed. The method includes introducing treatment fluid into the wellhead end of the production tubing string, allowing an applicator fall through the production tubing string thus applying a first coating of treatment fluid and retracting the applicator thus applying a second coating of the treatment fluid.

11 Claims, 2 Drawing Sheets

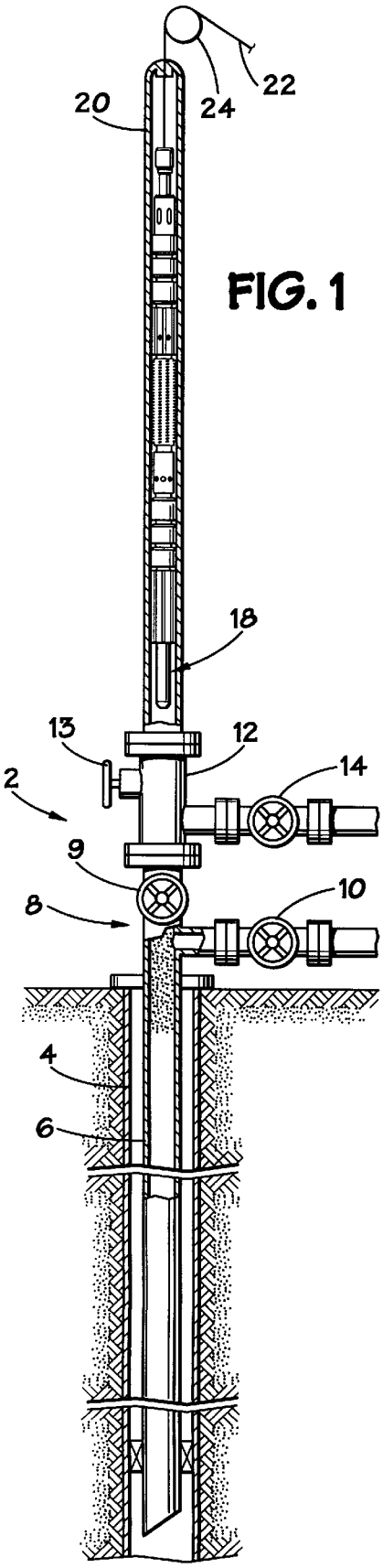
FIG. 1
FIG. 2
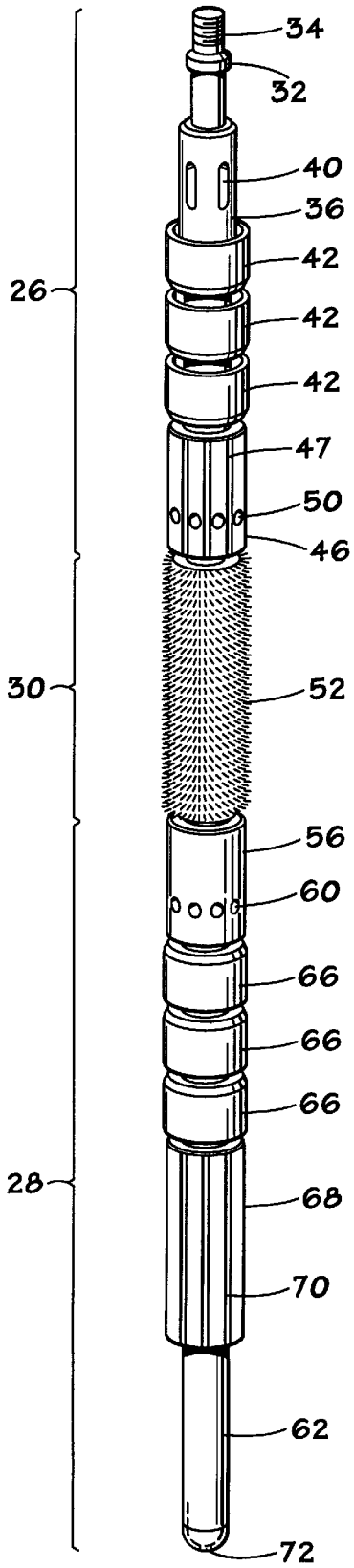

INTERIOR COATING OF GAS WELL TUBING

BACKGROUND OF THE INVENTION

1. Field of the Invention

The present invention is generally directed to a method for the treatment of gas wells with a treatment fluid and the apparatus used in the inventive method. More particularly, the method is useful for the treating of flowing gas wells with an anticorrosion treatment fluid.

2. Background

Natural gas is produced from wells that are drilled into underground formations which contain geologically formed mixtures of methane, ethane, propane, and other gaseous hydrocarbons. In addition to the useful hydrocarbons, other gases may have formed with the natural gas that are corrosive to the metal production tubing string through which the gas is brought to the surface. Over time these naturally occurring corrosive gases cause the formation of scale and create corrosion problems on the inner surface of the production tubing string of the flowing gas well. If this condition is left untreated, the production tubing string will eventually fail causing a costly and unsafe uncontrolled release of the natural gas.

In order to prevent corrosion and scale build-up within the producing pipe string, the inside of the production tubing string is treated with conventional corrosion inhibitors. The success in treating the inner surface of the production tubing string depends upon the ability of to apply a protective film or layer of corrosion inhibitor along the entire length of the production tubing string. There are several methods for attempting to achieve this goal.

The most common method used to treat the production tubing string of flowing gas wells is the "batch and fall" method. The "batch and fall" method is carried out by stopping the flow of gas (i.e. stopping production) and introducing a given volume of treatment fluid into the wellhead end of the production tubing string. The treatment fluid is usually followed by a flushing fluid which helps force the treatment fluid down the production tubing string. The treatment fluid and the flush fluid are then allowed to "fall" though the length of the production tubing string thus coating its inside surface with treatment fluid. Typically the fall rate will be anywhere from 1000 feet per hour (305 meters per hour) to 3000 feet per hour (915 meters per hour). The fall rate depends upon many factors including the viscosity of the treatment fluid, the diameter of the production tubing string, the natural gas pressure of the well, and so forth. Because of these variables, the time required for the complete treatment of the production tubing string is unpredictable. If the well is returned to production too soon, the treatment fluid will not have coated the entire length of the production tubing string thus leaving the bottom of the production tubing string unprotected. However, if the well is left off production for too long, the treatment fluid and the flushing fluid may migrate into the gas producing formation. This latter case is undesirable because the fluids might cause damage to the formation and prevent or inhibit the flow of natural gas from the underground formation.

Several methods of treating the inner surface of a production tubing string have been previously described and for one reason or another have had only limited success or less than desirable results. Examples of such methods include squeeze treatment and tubing displacement. Both of these methods are less commonly utilized because they are more expensive than batch and fall methods and increase the chance of formation damage. Other unpopular methods include using nitrogen gas to flush the treatment fluid down the production tubing string, using aerosol type inhibitors, or using specially weighted inhibitors, inhibitor stick or brush applicator tools to make the application more uniform and predictable. The last noted of these methods, utilizes a brush applicator tool to push the treatment fluid through the production tubing string while at the same time the brush "paints" the treatment fluid onto the inside surface of the production tubing string. The rate at which the brush applicator applies the treatment fluid is approximately 125 feet per minute (38 meters per minute). The primary problem with this latter method is that although it is faster than the batch and fall treatment method, the time required for the complete application of the treatment fluid is longer than desired.

Therefore there exists a continuing need for improved methods of applying treatment fluid on the inside surface of the production tubing string of a gas well.

SUMMARY OF THE INVENTION

The present invention is generally directed to a method and apparatus for the treatment of a gas well production tubing string with a treatment fluid. The method utilizes an apparatus which includes an upper conduit having closed upper and lower ends and adapted at its upper end to be raised and lowered within the well. The upper conduit defines at least one first sidewall opening proximate its upper end and at least one second side wall opening proximate its lower end to provide fluid communication between the interior of the upper conduit and the annulus between the upper conduit and the inner wall surface of the production tubing string. The apparatus further includes at least one first swab positioned on the outer wall surface of the upper conduit between the first and second sidewall openings and configured to swab the inner wall surface of the production tubing string. In addition the apparatus includes a lower conduit having a closed upper end and connected at its upper end to the lower end of the upper conduit. The lower conduit defines at least one third sidewall opening proximate its upper end to provide fluid communication between the interior of the lower conduit and the annulus between the lower conduit and the inner wall surface of the production tubing string. The lower end of the lower conduit defines at least one fourth opening to provide for fluid communication between the interior of the lower conduit and the space within the production tubing string below the lower conduit. At least one second swab is also included in the apparatus and is positioned on the outer wall surface of the lower conduit and configured to swab the inner wall surface of the production tubing string.

Also included as part of the apparatus is a channeled go/no-go device mounted on the lower end of the lower conduit. The apparatus may also include a friction member interconnecting the lower end of the upper conduit and the upper end of the lower conduit and characterized by the ability to remove portions of the inner wall surface of the production string. The friction member comprises of a connecting shaft interconnecting the lower end of the upper conduit and the upper end of the lower conduit. Mounted on the connecting shaft may optionally be a brush of a diameter such that the ends of the bristles are in contact with the inner surface of the production tubing string. The first swab and the second swab are orientated such that when one swab creates a pressure in the treatment fluid, the other swab applies a thin layer of treatment fluid onto the inner surface of the production tubing string.

BRIEF DESCRIPTION OF THE DRAWINGS

These and other features of the present invention are more fully set forth in the following description of illustrative embodiments of the invention. The description is presented with reference to the accompanying drawings in which:

FIG. 1 is a cutaway view of a gas wellhead illustrating a preferred embodiment of the present invention.

FIG. 2 is a elevational view of an applicator used in a preferred embodiment of the method of the present invention.

DESCRIPTION OF ILLUSTRATIVE EMBODIMENTS

Figure 3:
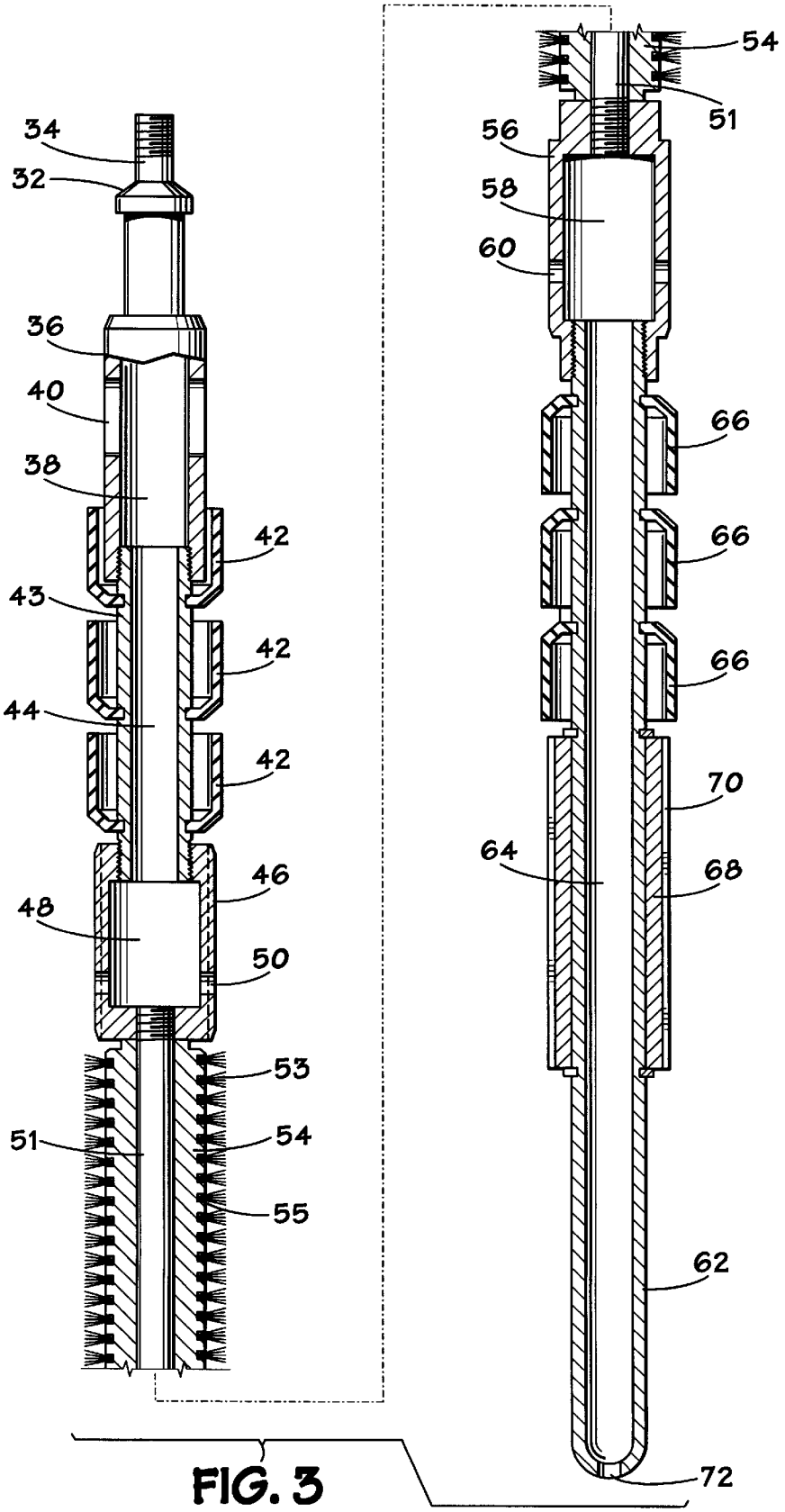
FIG. 3 is a cross-sectional view along the longitudinal axis of an applicator used in a preferred embodiment of the method of the present invention.

The following terms and phrases are used herein and are intended to have the following meaning:

"production tubing string", "producing pipe string", "producing string", "production tubing", "string" and "tubing" may be used interchangeably and intended to mean any metallic tubing used in a natural gas well that serves as a conduit for natural gas between the underground gas bearing formation and the surface;

"treatment fluid" means any conventional, commercially available fluid, grease, paste, gel or the like that is used to coat the surfaces of a gas well production tubing string to at least deter corrosion, build up or scale or other harmful deterioration of the production tubing string.

Turning now to FIG. 1, a wellhead of a natural gas well 2 is shown with a preferred embodiment of an apparatus of the present invention positioned so as to be used in accordance with a preferred embodiment of a method of the present invention. The illustrative gas well includes a well casing 4 which serves as a support for the well and prevents the well from caving in or collapsing. Inside the well casing is at least one production tubing string 6. One end of the production tubing string extends above ground and is called the wellhead end which is illustrated in the figure. The other end of the production tubing string (not shown) is in fluid connection with the gas bearing subterranean formation and thus is called the downhole end. The role of the production tubing string is to serve as a conduit for the natural gas so that it can be brought up to the surface and utilized by people. The wellhead end of the production tubing string includes several valves and interconnections often referred to as a "tree". In FIG. 1. a simple two valve "tree" 8 is shown for the sake of simplicity, one skilled in the art would understand and know that in the actual field the "tree" may be much more complicated and have a plurality of valves. As shown the wellhead "tree" includes a side valve 10 which when gas is being produced is open and an top valve 9 which when open permits access to the interior of the production tubing string from above. During production of natural gas, the side valve is open and the top valve is closed. However, in the FIG. 1. production of gas is no longer underway and therefore the side valve is closed and the top valve is open. The wellhead tree is connected to a treatment fluid introduction adapter 12, which may be a permanent part of the "tree" or may be removable. The adapter as shown includes two valves, an upper 13 and a side valve 14. The treatment fluid is introduced into the interior of the wellhead end of the production tubing string by opening side valve 14 and closing the upper valve 13 and injecting an amount of the treatment fluid sufficient to coat the inner surface of the production string for it's entire length. One of skill in the art should recognize that the amount required will vary from well to well and on the thickness of the treatment fluid layer desired on the inside of the production string. Once the desired amount of treating fluid has been introduced into the wellhead end of the production tubing string, side valve 14 is closed and top valve 13 may be opened so that applicator 18 can be allowed to fall through the production string. Applicator 18 is described in greater detail below. In order to prevent the escape of natural gas from the well, the applicator is housed in a applicator housing 20 that is connected to the top of the "tree" and in a position such that the applicator can be introduced into the production tubing string. The upper end of the applicator is designed so that a wireline 22 can be attached. A pulley 24 or other similar means may be mounted either on the applicator housing, or it may be mounted on a separate support structure. The function of the pulley is to guide the wireline into a vertical position and to assist in the retraction of the applicator from the downhole end of the production tubing string.

The applicator which is useful in the practice of the method of the present invention may have several different embodiments. In one such embodiment, the apparatus for treating the inner wall surface of a production tubing string in a gas well includes a upper conduit having a closed upper end and a closed lower end. The upper end of the upper conduit is adapted at its upper end to be raised and lowered within the production tubing string. The upper conduit defines at least one first sidewall opening proximate to its upper end and at least one second side wall opening proximate its lower end. The role of the first and second sidewall openings is to provide fluid communication between the interior of the upper conduit and the space or annulus between the upper conduit and the inner wall surface of the production tubing string.

The embodiment also includes at least one first swab positioned on the outer wall surface of the upper conduit. The first swab is located between the first and second sidewall openings and is configured to swab the inner wall surface of the production tubing string. As the term "swab" is used herein, it is to mean a rubber sleeve or cup that is shaped or beveled so that when it travels in one direction within the production tubing string, it allows only a very minor amount of treatment fluid or other similar liquid to pass between the swab's outer surface and the inner surface of the production tubing string. However, when the swab travels in the opposite direction within the production tubing string, the swab applies a thin film (less than ⅛th of an inch) of the treatment fluid onto the inner surface of the production tubing string. The first swab is orientated so that when the applicator is falling downwardly through the production tubing string, it applies a thin film of treatment fluids. However, upon retraction of the applicator after it has completed its fall, the first swab allows only a very minor amount of treatment fluid to pass between the swab and the inner surface of the production tubing string. In this latter capacity, the first swab creates a pressure in the treatment fluid above the applicator and causes the treatment fluid to flow through the upper conduit.

The present embodiment further includes a lower conduit having a closed upper end connected to the closed lower end of the upper conduit. The sidewall of the lower conduit defines at least one, third sidewall opening proximate to its upper end. The third sidewall opening provides fluid communication between the interior of the lower conduit chamber and the space or annulus between the lower conduit and the inner wall surface of the production tubing string. The lower end of the lower conduit defines at least one fourth opening to provide for fluid communication between the interior of the lower conduit and the space within the production tubing string below the lower conduit.

Also included is at least one second swab positioned as the outer wall surface of the lower conduit. This second swab is similar in nature to the first swab except that it is orientated so that when the applicator is falling, the swab creates a pressure in the treatment fluid such that the treatment fluid is forced through the lower conduit. Upon retraction of the applicator, the second swab serves to apply a thin film of treatment fluid on the inner surface of the production tubing string.

Another embodiment of the applicator of the present invention is generally illustrated in FIG. 1 and is shown in more detail in FIG. 2 and FIG. 3. to which the following description makes reference.

The applicator of the present embodiment includes a top assembly 26, a middle assembly 30 and a bottom assembly 28. The top assembly 26 includes a fishing neck 32 having a sucker rod pin 34 affixed to the upper end. The fishing neck and sucker rod pin permit the retrieval of the applicator from the bottom of the well. This may be done by "fishing" for the applicator or preferably a wireline is attached by means of the sucker rod pin to the applicator. This latter preferred embodiment is illustrated in FIG. 1.

The top assembly also includes a top slotted by-pass housing 36 the upper wall of which is connected to the lower end of the fishing neck. The surrounding wall of the top slotted by-pass housing defines a top slotted by-pass chamber 38. The top slotted by-pass chamber is in fluid connection with the area of the production tubing above the applicator through a plurality of slots 40 in the surrounding walls of the top slotted by-pass housing. Connected to the top slotted by pass housing is a top swab by-pass tube 43. The top swab by-pass tube has an outer wall which has both inner and outer surfaces. The inner surface of the outer wall defining a top swab by-pass duct 44. The top swab by-pass duct is in fluid connection with the top slotted by-pass chamber.

On the outer surface of the outer wall of the top swab by-pass tube 43 is at least one top swab 42. The top swab is mounted so that so that when the applicator falls toward the downhole end of the gas well, the top swab applies a layer of treatment fluid on the inner surface of the production tubing string. Further, when the applicator passes in the opposite direction, the top swab prevents a majority of the treatment fluid from passing between the top swab and the inner surface of the production tubing string. By doing this the top swab cup creates a pressure in the fluids above the applicator and forces a majority of the fluid through the slots of the top slotted by-pass housing, through the top slotted by-pass chamber into the top swab by-pass duct. As shown in the drawings it is preferred that the upper swab be tapered on one end so that it functions as described above. The swab should be made of a rigid rubber material so that it is not readily deformed. The diameter of the swab is such that it allows for the application of a thin layer of treatment fluid on the inner surface of the production tubing string, but at the same time does not permit large portions of the treatment fluid to squeeze past it. In one embodiment the diameter of the swab is the same as or slightly smaller than the inner diameter of the production tubing string to be treated.

The top assembly further includes a top cylindrical applicator 46 having a cylindrical wall and a bottom wall, the cylindrical wall defining a top cylindrical applicator chamber 48. The top cylindrical applicator chamber is in fluid connection with the top swab by-pass duct. The cylindrical wall of the top cylindrical applicator has a plurality of top cylindrical applicator holes 50 which provide a fluid connection between the top cylindrical applicator chamber and the interior space of the production tubing surrounding the top cylindrical applicator. The function of the applicator is to "squirt" the treatment fluid onto the inner surface of the production tubing string thus increasing its distribution and decreasing the likelihood that a portion of the production tubing string goes untreated.

The middle assembly connects the upper assembly to the lower assembly and includes a connector 51 which preferably is a solid metal rod. Thus, in one embodiment of the present invention, the middle section is simply a metal rod that serves to connect the top assembly with the bottom assembly. In another embodiment, the connector is preferably a solid metal rod around which a brush 52 can be optionally mounted. The brush may be any type of suitable brush, but a spiracle brush of the type described below is preferred. In one preferred embodiment, the brush is mounted on the connecting rod so that it can be readily removed as is shown in the figures. Such a brush includes shell 54 in which there are spiracle grooves or channels 55. The brush is formed by placing the bristles 53 of the brush 52, across the spiracle groove and forcing the bristles into the groove thus assuming a "U" type shape by a retaining wire (not shown) wound into the groove. The retaining wire is secured to shell by conventional means such as pins or set screws. Thus the ends of the bristles point radially outward and are held in the spiracle groove of the shell by the retaining wire. In a preferred embodiment, the brush is of a length and size such that it does not move vertically, up and down the connector. The function of the brush is to gather corrosion and scale samples from the inner surface of the production tubing string. Therefore the length of the bristles of the brush, and thus the diameter of the brush should be approximately that of the producing tubing that is to be treated. One skilled in the are should know how to make a brush similar to that shown in the figures.

The bottom assembly 28 includes a bottom cylindrical applicator 56 having an upper wall and a cylindrical wall defining a bottom applicator chamber 58. The upper wall is connected to the lower end of the connector. The cylindrical wall has a plurality of bottom applicator holes 60 which form a fluid connection between the bottom applicator chamber and the interior space of the production tubing string surrounding the bottom cylindrical applicator. The bottom cylindrical applicator is connected to the bottom swab by-pass tube 62. The bottom swab by-pass tube has a closed lower wall and an outer wall. The inner surface of the outer wall of the bottom swab by-pass tube defines a bottom by-pass duct 64 which is in fluid connection with the lower applicator chamber. In the closed lower wall of the bottom swab by-pass tube, there is at least one bottom swab by-pass inlet hole 72. The bottom swab by-pass inlet hole forms a fluid connection between the bottom swab by-pass duct and the interior space of the production tubing string below the applicator. The role of the bottom swab by-pass inlet hole should be apparent to one of skill in the art given the present disclosure.

The bottom assembly further includes at least one bottom swab 66 which is functionally mounted on the outer surface of the outer wall of the bottom swab by-pass tube. The bottom swab is positioned such that when the applicator falls toward the downhole end of the gas well, the bottom swab prevents a majority of the treatment fluid from passing between the bottom swab and the inner surface of the production tubing. when the applicator passes in the opposite direction, the bottom swab applies a layer of treatment fluid onto the surface of the production tubing string. In the preferred embodiment the bottom swab is of the same type as the upper swab except that the bottom swab's orientation is opposite that of the upper swab.

Also functionally mounted on the outer surface of the swab by-pass tube is a channeled go/no-go device 70. The function of the channeled go/no-go device is to prevent the applicator from passing into a production tubing string of an improper size for the applicator. In this role the go/no-go device prevents the applicator from becoming stuck or inserted into production tubing that is too small of a diameter.

The method of the present invention may utilize either of the above disclosed applicators in the application of treatment fluid onto the inner surface of a gas well production tubing string. Generally the method of the present invention includes the introduction of treatment fluid into the well head end of the production tubing string in an amount sufficient to coat the inner surface of the production tubing string for its entire length. The applicator of the present invention is then introduced into the wellhead end of the production tubing string above the treatment fluid. The applicator is then allowed to "fall" the length of the production tubing string so as to coat the inside surface with a first coating of treatment fluid. Once the applicator has reached the downhole end of the production tubing string, the applicator is then retracted or withdrawn. During this retraction process the applicator applies a second coating of treatment fluid to the inner surface of the production tubing string.

One preferred embodiment of the inventive method utilizes the applicator illustrated in FIGS. 2 and 3 and described above. In that embodiment the method includes introducing into the wellhead end of the production tubing string an amount of treatment fluid sufficient to coat the desired length of inner surface of the production tubing string. The applicator is lowered into the wellhead end of the production tubing string on top of the treatment fluid. The applicator is then allowed to fall by gravity through the production tubing string until it is either stopped intentionally by the operator, or by the bottom of the well at the downhole end of the production tubing string. By allowing the applicator to fall through the production tubing string, a first coating of the treatment fluid is applied to the inner surface of the production tubing string.

As the applicator is falling, a first portion of the treatment fluid is forced by the applicator toward the downhole end of the production tubing string. This first portion is utilized by the applicator to coat lower sections of the production tubing string. A second portion of the treatment fluid passes through the bottom swab by-pass tube inlet hole into the bottom swab by-pass duct, through the bottom applicator chamber and out the bottom applicator holes. As the treatment fluid is forced out the bottom applicator holes, it is squirted onto the inner surface of the production tubing string.

In the absence of a brush, the second portion of the treatment fluid that has been squirted onto the inner walls of the production tubing string moves past the middle assembly and through the top cylindrical applicator holes into the top cylindrical applicator chamber. When a brush is employed as part of the middle section, the treatment fluid flows between the bristles of the brush. The primary purpose of the brush bristles is to remove and hold any scale or evidence of corrosion for analysis on the surface. The second portion of the treatment fluid then enters the top swab by-pass duct by way of the top applicator holes. The treatment fluids then pass into the top slotted by-pass chamber and out the top slotted chamber inlet slots and into a portion of the production tubing string above the applicator.

A third portion of the treatment fluid passes through the bottom swab by-pass tube inlet hole into the bottom swab by-pass duct, and the bottom applicator chamber and out the bottom applicator holes so that the third portion of the treatment fluid contacts the inner surface of the production tubing string and is coated onto the inner surface of the production tubing string by at least one top swab so as to form a first coating of treatment fluid on the inner surface of the production tubing string.

Upon reaching the downhole end of the production tubing string, the applicator is retracted, thus applying a second coating of the treatment fluid to the inner surface of the production tubing string. In doing so the second portion of the treating fluid, that is to say the portion that flowed through the applicator is divided into a fourth, fifth, and sixth portion. The fourth portion of the treatment fluid is forced by the applicator toward the wellhead end of the production tubing string and the unused portion is removed once the applicator has reached the surface.

The fifth portion of the treatment fluid passes through the top slotted by-pass chamber inlet slots into top slotted by-pass chamber to the top swab by-pass duct to the top cylindrical applicator chamber. The fifth portion is then forced out the top cylindrical applicator holes and is squirted onto the walls of the production tubing string. A majority of this fifth portion of treatment fluid flows past the middle assembly and is coated onto the inner surface of the production tubing string by at least one bottom swab so as to form a second coating of treatment fluid on the inner surface of the production tubing string.

The sixth portion of the treatment fluid follows the same initial path and the fifth portion, but instead of forming the second coating it passes through the bottom cylindrical applicator holes into the bottom cylindrical applicator chamber to the bottom swab by-pass duct. From there it flows out the bottom swab by-pass tube inlet hole and into a portion of the production tubing string below the applicator.

One advantage of practicing the above noted method is that the rate at which the treatment fluid is applied to the inner surface of the production tubing string is more predicable and uniform. Thus in one embodiment, the rate at which the applicator falls through the production tubing string is greater than 200 feet per minute. At such a rate, the amount of downtime needed for the treatment of the well is significantly reduced. That is to say, it may take a couple of hours to treat a gas well using the method of the present invention verses a day or two using the batch and fall method. Another advantage of the present invention is that the thickness and uniformity of the coating of the production tubing string is enhanced over the prior art methods. One of skill in the art would understand and appreciate this advantage because a more uniform coating of treatment fluid prevents spot corrosion and other similar problems. Yet a third advantage of the present invention is that scale and corrosion samples are gathered at the same time as the treatment process therefore reducing down time.

While the structures and methods of the present invention have been described in terms of preferred embodiments, it will be apparent to those of skill in the art that variations may be applied to the what has been described herein without departing from the concept, spirit and scope of the invention. All such similar substitutes and modifications apparent to those skilled in the art are deemed to be within the spirit, scope and concept of the invention as it is set out in the following claims.

What is claimed is:

1. An apparatus for treating an inner wall surface of a production tubing string in a gas well which comprises:

an upper conduit having closed upper and lower ends and adapted at its upper end to be raised and lowered within the well; the conduit defining at least one first sidewall opening proximate its upper end and at least one second side wall opening proximate its lower end to provide fluid communication between the interior of the upper conduit and the annulus between the upper conduit and the inner wall surface of the production tubing string;

at least one first swab positioned on the outer wall surface of the upper conduit between the first and second sidewall openings and configured to swab the inner wall surface of the production tubing string;

a lower conduit having a closed upper end and a closed lower end, the closed upper end being connected to the lower end of the upper conduit, the lower conduit defining at least one third sidewall opening proximate its upper end to provide fluid communication between the interior of the lower conduit and the annulus between the lower conduit and the inner wall surface of the production tubing string and the lower end defining a fourth opening to provide fluid communication between the interior of the lower conduit and the space within the production tubing string below the lower conduit; and at least one second swab positioned on the outer wall surface of the lower conduit and configured to swab the inner wall surface of the production tubing string.

2. The apparatus of claim 1 further comprising a channeled go/no-go device mounted on the lower end of the lower conduit.

3. The apparatus of claim 2 further comprising a friction member interconnecting the lower end of the upper conduit and the upper end of the lower conduit and characterized by the ability to remove deposits, scale or other build-ups on the inner wall surface of the production string.

4. The apparatus of claim 3 wherein the friction member comprises a connecting shaft is shaft interconnecting the lower end of the upper conduit and the upper end of the lower conduit, and functionally mounted on the connecting a brush, the brush being of a diameter such that the ends of the bristles are in contact with the inner surface of the production tubing string.

5. The apparatus of claim 4 wherein the first swab and the second swab are orientated such that when one swab creates a pressure in the treatment fluid, the other swab applies a thin layer of treatment fluid onto the inner surface of the production tubing string.

6. The apparatus of claim 4 wherein the apparatus applies a coating of treatment fluid to the inner surface of the production tubing string at a rate greater than about 200 feet per minute.

7. A method of treating an internal surface of a production tubing in a gas well which comprises:

injecting a treating fluid into the well to at least partially fill the well;

lowering the apparatus defined in claim 1 into the well sufficiently to:

(a) force treating fluid in the well sequentially through each third sidewall opening, each second sidewall opening and each first sidewall opening, and (b) enable the first swabs to swab the inner wall surface of the production string with the treating fluid.

8. The method of claim 7 further comprising raising the apparatus sufficiently to:

(a) force treating fluid sequentially through the first, second, and third sidewall openings; and (b) enable the second swabs to swab the inner wall surface of the production string with the treating fluid.

9. A method of applying a thin layer of a treatment fluid to an inner surface of a production tubing string in a subterranean gas well, the production tubing string having a wellhead end and a downhole end, the wellhead end being above ground and the downhole end being at the subterranean terminus of the gas well, the method comprising:

introducing the treatment fluid into the wellhead end of the production tubing string in an amount sufficient to coat the inner surface, lowering into the wellhead end of the production tubing string an applicator, the applicator comprising:

a top assembly including:

a fishing neck having an upper and lower end, a sucker rod pin being functionally affixed to the upper end;

a top slotted by-pass housing having an upper and surrounding wall, the upper wall being connected to the lower end of the fishing neck, and the surrounding wall of the top slotted by-pass housing defining a top slotted by-pass chamber, the chamber being in fluid connection with the area of the production tubing above the applicator by a plurality of slots in the surrounding walls of the top slotted by-pass housing;

a top swab by-pass tube, the top swab by-pass tube having an outer wall having inner and outer surfaces, the inner surface of the outer wall defining a top swab by-pass duct, the top swab by-pass duct being in fluid connection with the top slotted by-pass chamber;

at least one top swab, the top swab being functionally mounted on the outer surface of the outer wall of the top swab by-pass tube so that when the applicator falls toward the downhole end of the gas well, the top swab applies a layer of treatment fluid on the inner surface of the production tubing string and so that when the applicator passes in the opposite direction, the top swab prevents a majority of the treatment fluid from passing between the top swab and the inner surface of the production tubing;

a top cylindrical applicator having a cylindrical wall and a bottom wall, the cylindrical wall defining a top cylindrical applicator chamber, the top cylindrical applicator chamber being in fluid connection with the top swab by-pass duct, the cylindrical wall also having a plurality of top cylindrical applicator holes the holes providing a fluid connection between the top cylindrical applicator chamber and the interior space of the production tubing surrounding the top cylindrical applicator;

a middle assembly including:

a connecting shaft having upper and lower ends, the upper end being connected to the bottom wall of the top assembly, and optionally a brush, the brush being functionally mounted on the connecting shaft so as to gather corrosion and scale samples from the inner surface of the production tubing string, and a bottom assembly including:

a bottom cylindrical applicator having an upper wall, the upper wall being connected to the lower end of the connecting shaft, and a cylindrical wall defining a bottom applicator chamber, the cylindrical wall having a plurality of bottom applicator holes, the bottom applicator holes forming a fluid connection between the bottom applicator chamber and the interior space of the production tubing string surrounding the bottom cylindrical applicator;

a bottom swab by-pass tube, the bottom swab by-pass tube having a closed lower wall and an outer wall, the outer wall having an inner surface and an outer surface, the inner surface of the outer wall defining a bottom by-pass duct, the bottom by-pass duct being in fluid connection with the lower applicator chamber;

at least one bottom swab, the bottom swab being functionally mounted on the outer surface of the outer wall of the bottom swab by-pass tube so that when the applicator falls toward the downhole end of the gas well, the bottom swab prevents a majority of the treatment fluid from passing between the bottom swab and the inner surface of the production tubing, and so that when the applicator passes in the opposite direction, the bottom swab applies a layer of treatment fluid onto the surface of the production tubing string;

a channeled go/no-go device, the channeled go/no-go device being functionally mounted on the outer surface of the outer wall of the bottom assembly by-pass tube so as to prevent the applicator from passing through a production tubing string of a improper size for the applicator and thus becoming stuck therein;

a bottom swab by-pass tube inlet hole, the bottom swab by-pass inlet hole being in the closed lower wall of the bottom swab by-pass tube so as to form a fluid connection between the bottom swab by-pass duct and the interior space of the production tubing string below the applicator;

applying a first coating of the treatment fluid to the inner surface of the production tubing string by allowing the applicator to fall from the wellhead end to the downhole end of the production tubing string such that a first portion of the treatment fluid is forced by the applicator toward the downhole end of the production tubing string, a second portion of the treatment fluid passes through the bottom swab by-pass tube inlet hole into the bottom swab by-pass duct, and the bottom applicator chamber and out the bottom applicator holes, past the middle assembly and through the top cylindrical applicator holes into the top cylindrical applicator chamber to the top swab by-pass duct, to the top slotted by-pass chamber and out the top slotted chamber inlet slots and into a portion of the production tubing string above the applicator, and a third portion of the treatment fluid passes through the bottom swab by-pass tube inlet hole into the bottom swab by-pass duct, and the bottom applicator chamber and out the bottom applicator holes so that the third portion of the treatment fluid contacts the inner surface of the production tubing string and is coated onto the inner surface of the production tubing string by at least one top swab so as to form a first coating of treatment fluid on the inner surface of the production tubing string; and applying a second coating of the treatment fluid to the inner surface of the production tubing string by retracting the applicator from the downhole end of the production tubing string to the wellhead end of the production tubing string so that the second portion of the treating fluid is divided into a fourth, fifth, and sixth portion such that the fourth portion of the treatment fluid is forced by the applicator toward the wellhead end of the production tubing string, the fifth portion of the treatment fluid passes through the top slotted by-pass chamber inlet slots into top slotted by-pass chamber, to the top swab by-pass duct, to the top cylindrical applicator chamber and out the top cylindrical applicator holes so that the sixth portion of the treatment fluid contacts the inner surface of the production tubing string and is coated onto the inner surface of the production tubing string by at least one bottom swab so as to form a second coating of treatment fluid on the inner surface of the production tubing string; and the sixth portion of the treatment fluid passes through the top slotted by-pass chamber inlet slots into top slotted by-pass chamber, to the top swab by-pass duct, to the top cylindrical applicator chamber and out the top cylindrical applicator holes, past the middle assembly and through the bottom cylindrical applicator holes into the bottom cylindrical applicator chamber to the bottom swab by-pass duct and out the bottom swab by-pass tube inlet hole and into a portion of the production tubing string below the applicator.

10. The method of claim 9, wherein the first application of treatment fluid occurs at a rate greater than about 200 feet per minute.

11. An applicator for gas well production tubing, said applicator comprising:

a top assembly including:

a fishing neck having an upper and lower end, a sucker rod pin being functionally affixed to the upper end;

a top slotted by-pass housing having an upper and surrounding wall, the upper wall being connected to the lower end of the fishing neck, and the surrounding wall of the top slotted by-pass housing defining a top slotted by-pass chamber, the chamber being in fluid connection with the area of the production tubing above the applicator by a plurality of slots in the surrounding walls of the top slotted by-pass housing;

a top swab by-pass tube, the top swab by-pass tube having an outer wall having inner and outer surfaces, the inner surface of the outer wall defining a top swab by-pass duct, the top swab by-pass duct being in fluid connection with the top slotted by-pass chamber, at least one top swab, the top swab being functionally mounted on the outer surface of the outer wall of the top swab by-pass tube so that when the applicator falls toward the downhole end of a gas well, the top swab applies a layer of treatment fluid on the inner surface of the production tubing string and so that when the applicator passes in the opposite direction, the top swab prevents a majority of the treatment fluid from passing between the top swab and the inner surface of the production tubing;

a top cylindrical applicator having a cylindrical wall and a bottom wall, the cylindrical wall defining a top cylindrical applicator chamber, the top cylindrical applicator chamber being in fluid connection with the top swab by-pass duct, the cylindrical wall also having a plurality of top cylindrical applicator holes the holes providing a fluid connection between the top cylindrical applicator chamber and the interior space of the production tubing surrounding the top cylindrical applicator;

a middle assembly including:

a connecting shaft having upper and lower ends, the upper end being connected to the bottom wall of the top assembly, and optionally a brush, the brush being functionally mounted on the connecting shaft so as to gather corrosion and scale samples from the inner surface of the production tubing string, and a bottom assembly including:

a bottom cylindrical applicator having an upper wall, the upper wall being connected to the lower end of the connecting shaft, and a cylindrical wall defining a bottom applicator chamber, the cylindrical wall having a plurality of bottom applicator holes, the bottom applicator holes forming a fluid connection between the bottom applicator chamber and the interior space of the production tubing string surrounding the bottom cylindrical applicator;

a bottom swab by-pass tube, the bottom swab by-pass tube having a closed lower wall and an outer wall, the outer wall having an inner surface and an outer surface, the inner surface of the outer wall defining a bottom by-pass duct, the bottom by-pass duct being in fluid connection with the lower applicator chamber; at least one bottom swab, the bottom swab being functionally mounted on the outer surface of the outer wall of the bottom swab by-pass tube so that when the applicator falls toward the downhole end of the gas well, the bottom swab prevents a majority of the treatment fluid from passing between the bottom swab and the inner surface of the production tubing, and so that when the applicator passes in the opposite direction, the bottom swab applies a layer of treatment fluid onto the surface of the production tubing string;

a channeled go/no-go device, the channeled go/no-go device being functionally mounted on the outer surface of the outer wall of the bottom assembly by-pass tube so as to prevent the applicator from passing through a production tubing string of a improper size for the applicator and thus becoming stuck therein;

a bottom swab by-pass tube inlet hole, the bottom swab by-pass inlet hole being in the closed lower wall of the bottom swab by-pass tube so as to form a fluid connection between the bottom swab by-pass duct and the interior space of the production tubing string below the applicator.

* * * * *